United States Patent [19]

Lewis

[11] Patent Number: 4,724,676

[45] Date of Patent: Feb. 16, 1988

[54] HEAT EXCHANGE MATRIX FOR REFRIGERATION APPARATUS

[75] Inventor: Geoffrey A. Lewis, West Midlands, England

[73] Assignee: Lucas Industries Ltd., Birmingham, England

[21] Appl. No.: 911,106

[22] Filed: Sep. 23, 1986

[30] Foreign Application Priority Data

Oct. 19, 1985 [GB] United Kingdom ..... 8525817

[51] Int. Cl.[4] ..... F25B 9/00

[52] U.S. Cl. ..... 62/6; 60/520

[58] Field of Search ..... 62/6; 60/520; 165/4, 165/10; 417/18, 32

[56] References Cited

U.S. PATENT DOCUMENTS

| | | | |
|---|---|---|---|
| 3,991,586 | 11/1976 | Acord | 62/6 |
| 4,259,844 | 4/1981 | Sarcia et al. | 62/6 |
| 4,359,872 | 11/1982 | Goldowsky | 62/6 |
| 4,366,676 | 1/1983 | Wheatley et al. | 62/6 |
| 4,404,808 | 9/1983 | Andeen | 62/6 |
| 4,543,793 | 10/1985 | Chellis et al. | 62/6 |

*Primary Examiner*—Steven E. Warner

*Attorney, Agent, or Firm*—Trexler, Bushnell, Giangiorgi & Blackstone, Ltd.

[57] ABSTRACT

A cryogenic refrigeration apparatus comprises an electrically actuated compressor which supplies a working fluid to a free moving displacer which includes a regenerator matrix, so that a container in which the displacer is slidable has a cold end and an ambient temperature end. The matrix comprises a plurality of heat exchange elements which are graded lenthwise of the displacer so as to have larger surface areas adjacent the colder end of the matrix and a reduced flow resistance at the ambient end. The actuator for the compressor is responsive to signals which indicate that the displacer is at the colder end of the container and that the temperature of the colder end is above a pedetermined value.

7 Claims, 7 Drawing Figures

HEAT EXCHANGE MATRIX FOR REFRIGERATION APPARATUS

This invention relates to a refrigeration apparatus of the general type shown in U.S. Pat. No. 3,991,586 and includes a compressor for cyclically varying the pressure of a gas volume, and a regenerator through which a part of the gas is repeatedly transferred in alternate directions. Heat is exchanged between the gas and the regeneration during these transfers. Gas transfer is effected by a reciprocating element, this element being commonly known as a displacer. The aforesaid prior art seeks to improve refrigeration efficiency by energizing the displacer in synchronism with the compressor.

The apparatus described hereafter provides an arrangement by means of which power consumption may be reduced, and cooling efficiency thereby increased.

It is necessary that the displacer shall have, for a given volume, a large surface area, and at the same time shall not restrict gas flow unacceptably. It is common practice to provide a matrix of wire gauze or small tubes within the displacer, a part of the gas passing through the matrix during each transfer. However, since the viscosity of a gas increases with its temperature the flow resistance of the usual type of the matrix is less at the colder end and greater at the hotter end of the displacer. In one of its aspects the present invention includes provision of a matrix which is graduated lengthwise of the displacer so as to provide the largest effective surface area consistent with an acceptable flow resistance at a plurality of locations along the displacer.

It is also required that the compressor and displacer shall operate in a predetermined phase relationship, and in another of its aspects the present invention provides an arrangement in which energization of the compressor is dependent on an operating position of the displacer.

According to the invention a refrigeration apparatus comprises a compressor, a bore having cold and ambient temperature ends and which communicates at one end with said compressor, a displacer plunger freely axially slidable in said bore, said plunger having therein a regenerator matrix through which a working fluid is constrained to flow as a result of axial movement of said plunger, said matrix comprising a plurality of heat exchange elements which are graded lengthwise of the plunger so as to have a larger total surface area at the colder end of said matrix.

According to a further aspect of the invention a refrigeration apparatus comprises a compressor, a bore having cold and ambient temperature ends and which communicates at one of its ends with said compressor, a displacer plunger freely axially slidable in said bore, said plunger having therein a regenerator matrix through which a working fluid is constrained to flow as a result of axial movement of said plunger, an actuator for said compressor, a device for generating a first signal when said plunger, is at a predetermined position of its axial movement, and means responsive to said first signal for energizing said actuator in a first direction.

An embodiment of the invention will now be described by way of example only and with reference to the accompanying drawings in which.

Figure 1:
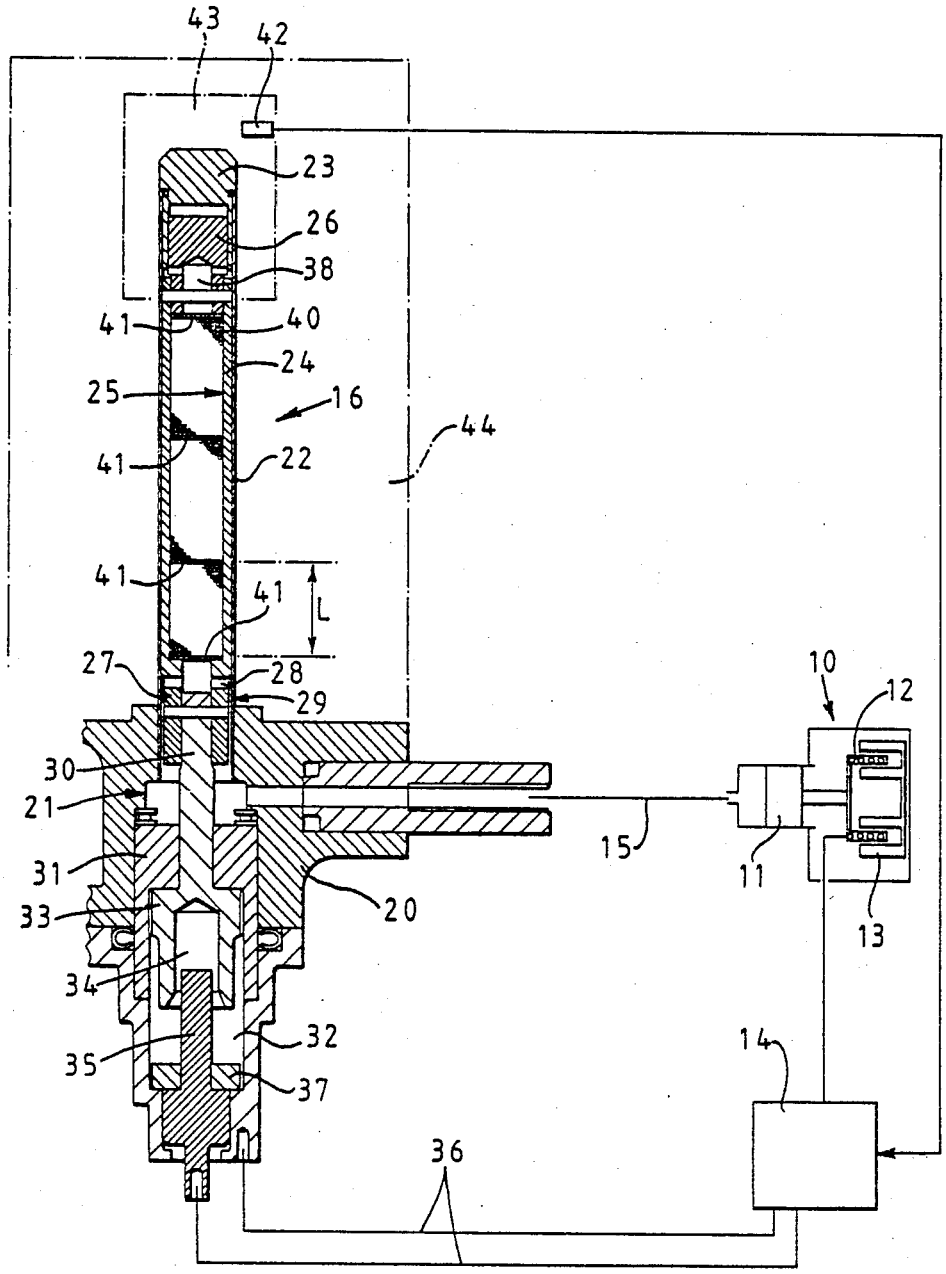
FIG. 1 is a diagram of a refrigeration apparatus.

FIG. 1 shows a modified Ericcson cycle refrigerator which comprises a compressor 10 for a working fluid which in the present example is helium. The compressor 10 has a piston 11 movable by a coil 12 which is located in the field of a permanent magnet 13. The coil is energizable by current supplied from a control circuit 14. The compressor 10 is connected through a 60 cm long pipe 15 to a cooling probe 16, which is shown to an enlarged scale.

The probe 16 comprises a housing 20 having a stepped bore 21 to which the pipe 15 is connected and from which a thin-walled tube 22 extends axially.

The end of the tube 22 remote from the housing 20 is closed by a plug 23. The tube 22 defines a bore in which a displacer plunger 24 is axially slidable. The plunger 24 has a through bore 25. An end cap 26 is secured in the plunger 24 and has axial and transverse passages 38 which communicate with the bore 25 and open on to the circumference of the cap 26. The cap 26 is slidable in the plug 23 with a diametral clearance of the order of 0.1 mm. The end 27 of the plunger 24 remote from the cap 26 has a substantial diametral clearance within the tube 22. Adjacent this latter end and over the length L the plunger has a diametral clearance of the order of 0.015 mm. Over the remainder of its length the plunger 24 has a diametral clearance of the order of 0.25 mm. A transverse bore 28 connects the bore 25 with an annular passage 29 provided by the clearance around the end 27, and hence with the pipe 15. A rod 30 is secured to the end 27 and passes through a wall 31 into a cylindrical chamber 32. The rod 30 terminates in a damper position 33 which is slidable in the chamber 32 with a diametral clearance of between 0.038 and 0.046 mm. The piston 33 has a blind bore 34 which can pass over a stem 35 which is sealingly mounted in the body 20 so as to be electrically insulated therefrom. The value of electrical capacitance between the piston 33 and stem 35 is dependent on the axial position of the plunger 24, and this capacitance is sensed by the circuit 14 through wires 36. A plastics buffer 37 surrounds the stem 35.

The bore of the plunger 24 is filled with a heat regenerator matrix. It is desirable that the smallest possible temperature difference shall exist between the working fluid and the elements which comprise the matrix. For this purpose the matrix should present the largest possible surface area to the working fluid, that is it should comprise a large number of elements of small cross-section. Such a matrix will, however result in increased resistance to fluid flow, this resistance increasing with increased viscosity of the working fluid.

In a typical Ericsson cycle refrigerator in which helium is the working gas the temperature at the cold end 26 of the plunger 24 is less than 70° K., and may exceed 300° K. at the hotter end 27. The viscosity of helium is given by $$\eta = A\ T^{1.5}/(T+B) \text{ poise}$$

and the thermal conductivity K by $$K = f \cdot CV \cdot A \cdot T^{1.5}/(T+B) \text{ watt/cm.° C.}$$

where, $f = 2.3$ $A = 1.47 \times 10^{-5}$ $B = 80$

CV = specific heat at constant pressure

T = gas temperature in °K.

When T = 70° K., $\eta = 5.74 \times 10^{-5}$ poise, and $K=4.17\times10^{-4}$ watt/cm.° C.

When T=300° C., $\eta=2\times10^{-4}$ poise, and $K=1.47\times10^{-3}$ watt/cm.° C.

In the particular example the matrix comprises a plurality of spherical glass beads 40. For a given volume of such beads the total surface area increases inversely as the bead diameter. Moreover, smaller beads reduce the length of the heat conduction path through the working fluid. The temperature difference between the fluid and the beads rises as the square of the bead diameter, and falls with increasing thermal conductivity of the fluid. Though for the foregoing reasons it is advantageous to reduce the bead diameter, such a reduction will increase flow resistance inversely as the square of the bead diameter. Flow resistance also increases with increased viscosity of the fluid which itself increases with temperature. The increase of viscosity with temperature renders it desirable to use beads of larger diameter adjacent the hot end 27. Though ideally the bead diameters would increase continuously from the end 26 to the end 27, it is more convenient to divide the bore 25 of the plunger 24 into a plurality of zones, as shown in FIG. 1, by means of wire gauze discs 41, each of the zones so obtained being filled with beads 40 of an appropriate size. In the example shown three such zones are provided.

In a particular example 0.0004 grams of helium are required to pass through a bead matrix of 0.23 $cm^3$ volume and 2.25 cm long in a time of 0.01 seconds, the cold and ambient end temperatures being 70° K. and 300° K. respectively. The absolute gas pressure is $10^7$ dyn/$cm^2$, and its specific heat at constant pressure Cp is 5.226 joules/gram °C. If the difference in temperature between the gas and bead matrix is not to exceed 1° C. at the colder end, it can be shown that the required bead diameter at the colder end is 0.0135 cm. If the gas pressure loss per unit length at the hotter end of the matrix is not to exceed that at the colder end, the diameter of the beads at the ambient temperature end must be increased to 0.052 cm.

Figure 2:
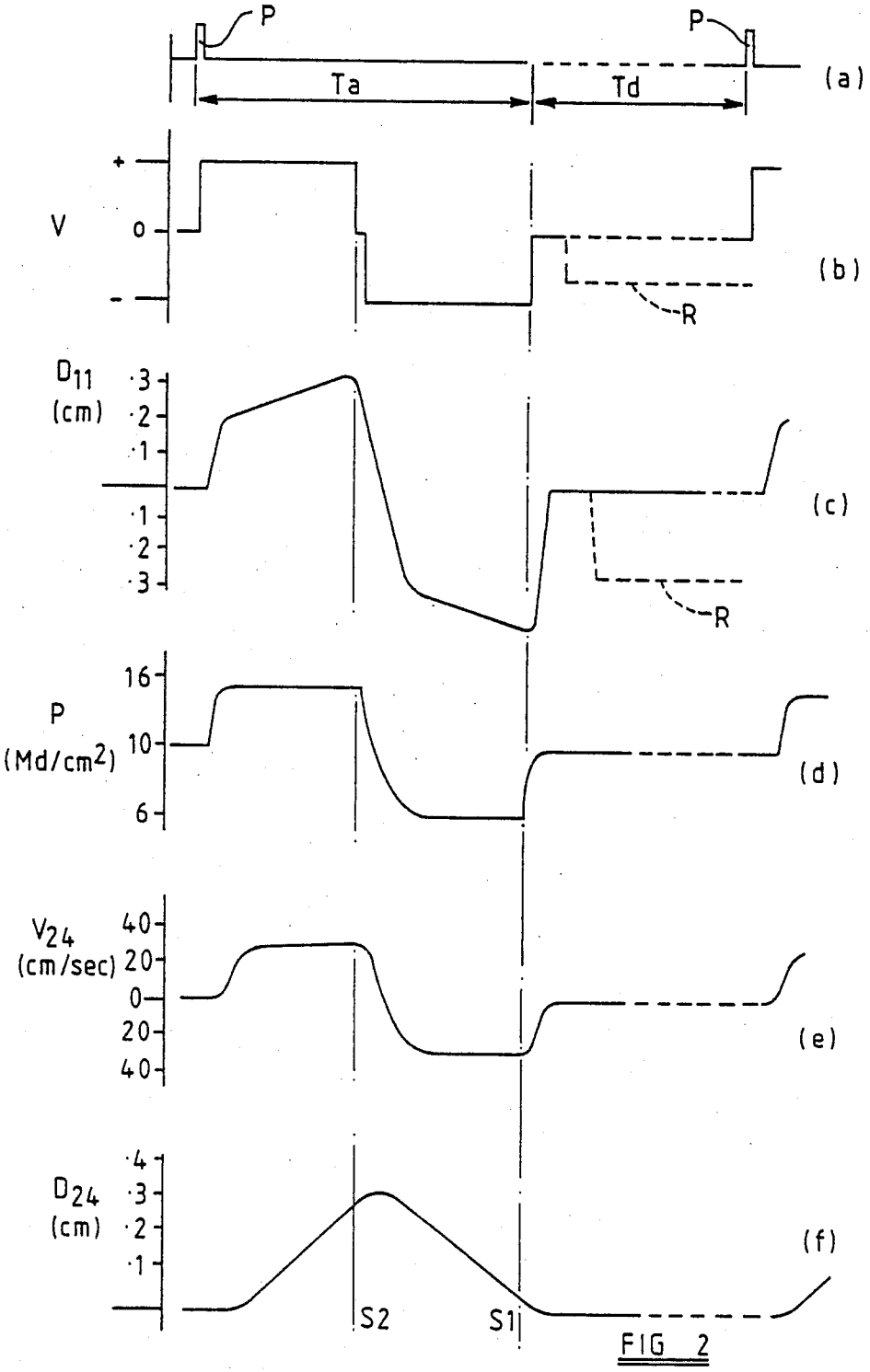
FIG. 2 shows the time relationship of operating conditions of the apparatus of FIG. 1.

FIG. 2 shows changes in operating conditions of the apparatus, plotted on the same horizontal time scale, the magnitude of the changes in these operating conditions being indicated where appropriate.

When the pressure in the pipe is at its rest value of 10 megadynes/$cm^2$, FIG. 2(*d*) the plunger 24 is in the position shown in FIG. 1.

The circuit 14 is responsive to signals from a temperature probe 42 in a zone 43 cooled by the refrigerator. The circuit 14 generates trigger pulses P as shown at (a) in FIG. 2, the interval between these pulses increasing as the temperature in the zone 43 approaches its desired level. If the plunger 24 is at or adjacent an end of its travel where the cap 26 is close to the plug 23, the capacitance sensed by the stem 35 provides a first signal level S1 on the line 36 and the circuit 14 responds to the signals S1 and P to energise the coil 12 by applying a positive voltage V thereto, as shown at (b) in FIG. 2. In response to the positive voltage V the piston 11 initially moves to compress the gas, as shown at (c). The first 0.2 cm of this movement is rapid and then reduces to a lower value after the gas reaches the pressure of 16 megadynes/$cm^2$ shown at (d). Thereafter the piston 11 moves relatively slowly to maintain a constant pressure as the gas density increases in response to a temperature drop.

The increased pressure acts on the effective diameter of the rod 30, urging the plunger 24 downwardly, as viewed in FIG. 1. Downward movement of the plunger 24 causes gas to pass through the matrix of beads 40 to the end 23. During this passage heat is transferred to the beads 40 in the matrix, cooling the gas and producing a small but tolerable increase in the matrix temperature.

As shown at FIG. 2(*e*) the velocity of the plunger 24 increases exponentially to a value of about 20 cm/sec and subsequently stays at a substantially constant value when the pressure difference across the damper piston 33 in combination with a small pressure difference across the matrix, has increased to a balancing value. After approximately 0.28 cm of movement, as indicated at FIG. 2(*f*) a second level S2 of the capacitance signal on lines 36 (FIG. 1) causes the polarity of the voltage on the coil 12 to be reversed (FIG. 2(*a*)) and the piston 11 is urged to allow the gas to expand to a pressure of 6 megadynes/$cm^2$ (FIG. 2(*d*)). During this expansion the gas temperature falls and heat can flow to the gas from the zone 43. The reduced net downward pressure on the plunger 24 and the pressure difference across the damper piston 33 combine to urge the plunger 24 upwards, returning gas from the end 23 to adjacent the end 27 of the plunger. Heat is transferred to the gas from the matrix beads 40 during its return through the regenerator. Any heat transferred to the gas from the zone 43 passes to the end 27 and is then lost by way of the housing 20. As indicated above the temperature difference between the gas and the bead matrix is very small, being or the order of 1° C.

The above-described phases of compression, cooling, expansion and heating comprise a single cycle which takes place in time Ta (FIG. 2(*a*)). A dwell time Td then occurs until the next initiating pulse, the total time Ta+Td between pulses P increasing as the sensed temperature in the zone 43 falls. When the sensed temperature is at or below its desired value the pulses P in FIG. 2(*a*) are not generated and the coil 12 is not energized in either direction. During the dwell times Td the plunger 24 is, of course, stationary, and in the upper position shown in FIG. 1, so that the first signal level S1 is maintained. With the plunger 24 stationary the temperature of each part of the plunger 24 is substantially the same as that of the immediately adjacent part of the tube 22. When the plunger 24 moves downwards, the temperature gradient along the regenerator 16 results in the aforesaid parts of the plunger 24 being raised in temperature by the parts of the tube 22 to which they are now adjacent. The amount of heat so transferred will increase with the total amount of time in which the plunger is at its downward end. Continuous movement of the plunger 24 will thus tend to result in stepwise transfer of heat towards the end 23, and thereby to reduce the net cooling effect of the apparatus. This effect is minimized by providing that the dwell times are as long as is consistent with obtaining the desired temperature in the zone 43.

During operation of the apparatus some gas may leak past the piston 11, tending to reduce the mean pressure of the gas in the working volume. As shown diagrammatically in FIG. 1 the compressor 10 has a sealed housing which encloses both the piston 11 and its electrical actuator 12, 13 and this housing is filled with helium. If the mean pressure falls below an acceptable level the compressor 10 is energized during a dwell time Td so as temporarily to lower the mean pressure still further, and cause gas to leak back past the piston 11 and thereby restore the system pressure. This operation is indicated at R in FIG. 2 (b) and (c). I will be understood that since the plunger 24 is in its upper position during each dwell time Td, the recharging operation does not affect the refrigeration cycle.

Clearance between the stem 30 and the wall 31 is such that slight leakage into the chamber 32 can occur. This ensures that the mean pressure in the chamber 32 is equal to the mean pressure in the pipe 15 during a dwell time Td.

In an alternative embodiment a plurality of wire gauze discs, which lie in planes normal to the long axis of the plunger 24, may be substituted for the beads 40. The diameters of the wires and their spacing is varied progressively along the length of the matrix so as to provide a larger surface area and a reduced resistance to flow of the working fluid as the ambient end is approached.

Alternatively the matrix may comprise bundles of fibers, for example glass fibres, of progressively reducing diameters and separated by discs 41 in the same manner as for the beads 40.

I claim:

1. A refrigeration apparatus comprising a compressor, a bore having cold and ambient temperature ends and which communicates at one end with said compressor, a displacer plunger, freely axially slidable in said bore, said plunger having therein a regenerator matrix through which a working fluid is constrained to flow as a result of axial movement of said plunger, said matrix comprising a plurality of heat exchange elements which are graded lengthwise of the plunger so as to have a larger total surface area at the colder end of said matrix.

2. An apparatus as claimed in claim 1 in which said heat exchange elements comprise a plurality of wire gauze discs disposed transversely of said plunger.

3. An apparatus as claimed in claim 1 in which said heat exchange elements comprise a plurality of substantially spherical beads, the diameter of said beads increasing with increase in distance from said colder end of the matrix.

4. An apparatus as claimed in claim 3 in which said beads are arranged as a plurality of groups which respectively comprise beads substantially the same size.

5. An apparatus as claimed in any preceding claim in which said compressor comprises a piston, and a reversibly energizable electromagnetic actuator coupled to said piston.

6. An apparatus as claimed in claim 5 which includes a device for generating a first signal when said plunger is at a predetermined position of its axial movement, and a circuit responsive to said first signal for energising said actuator.

7. An apparatus as claimed in claim 6 which includes means for generating a further signal when said cold end of said bore is above a predetermined temperature, said circuit energising said actuator only in the presence of said first and further signals.

* * * * *